US008231380B2

(12) United States Patent
Tsiava et al.

(10) Patent No.: US 8,231,380 B2
(45) Date of Patent: Jul. 31, 2012

(54) COMBUSTION METHOD WITH CYCLIC SUPPLY OF OXIDANT

(75) Inventors: Rémi Tsiava, Saint Germain-les-Corbeil (FR); Benoit Grand, Versailles (FR); Patrick Recourt, Marcoussis (FR); Bertrand Leroux, Issy-les-Moulineaux (FR)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 497 days.

(21) Appl. No.: 11/721,345

(22) PCT Filed: Dec. 5, 2005

(86) PCT No.: PCT/FR2005/051033

§ 371 (c)(1),
(2), (4) Date: Jun. 11, 2007

(87) PCT Pub. No.: WO2006/064144

PCT Pub. Date: Jun. 22, 2006

(65) Prior Publication Data

US 2009/0239182 A1 Sep. 24, 2009

(30) Foreign Application Priority Data

Dec. 13, 2004 (FR) ..... 04 52949

(51) Int. Cl.
*F23N 1/02* (2006.01)

(52) U.S. Cl. ..... 431/12; 431/176; 431/178; 431/350; 110/347; 122/7 R

(58) Field of Classification Search ..... 431/12, 431/176, 178, 350; 110/341; 122/7 R
See application file for complete search history.

(56) References Cited

U.S. PATENT DOCUMENTS

| | | | | |
|---|---|---|---|---|
| 5,302,111 | A | 4/1994 | Jouvaud et al. | |
| 5,441,000 | A * | 8/1995 | Vatsky et al. | 110/265 |
| 2,711,769 | A | 6/1996 | Drogue et al. | |
| 6,910,879 | B2 * | 6/2005 | Dugue et al. | 431/8 |
| 2003/0054301 | A1 | 3/2003 | Borders et al. | |
| 2005/0166867 | A1 * | 8/2005 | LaRue | 122/7 R |

FOREIGN PATENT DOCUMENTS

| | | |
|---|---|---|
| EP | 0 524 880 | 1/1993 |
| EP | 0 748 981 | 12/1996 |
| FR | 2 711 769 | 5/1995 |
| FR | 2 853 953 | 10/2004 |
| WO | WO 02 081967 | 10/2002 |

OTHER PUBLICATIONS

International Search Report for PCT/FR2005/051033, Mar. 29, 2006.

* cited by examiner

*Primary Examiner* — Steven B McAllister
*Assistant Examiner* — Avinash Savani
(74) *Attorney, Agent, or Firm* — Christopher J. Cronin

(57) ABSTRACT

The invention concerns a combustion method for industrial furnace comprising an arrangement of two substantially parallel and symmetrical burner assemblies (G, D). Each burner assembly comprises a fuel injector (10<SUB>G</SUB>, 10<SUB>D</SUB>) and three oxidant injectors (1<SUB>G</SUB>, 2<SUB>G</SUB>, 3<SUB>G</SUB>, 1<SUB>D</SUB>, 2<SUB>D</SUB>, 3<SUB>D</SUB>) arranged at increasing distances from the fuel injector. An oxidant supply system cyclically distributes a specific flow of oxidant among some at least of the second and third injectors of the burner assemblies (2<SUB>G</SUB>, 3<SUB>G</SUB>, 2<SUB>D</SUB>, 3<SUB>D</SUB>). The amount of nitrogen monoxide produced upon combustion is thus reduced, while ensuring a good distribution of the heating power in the furnace.

10 Claims, 4 Drawing Sheets

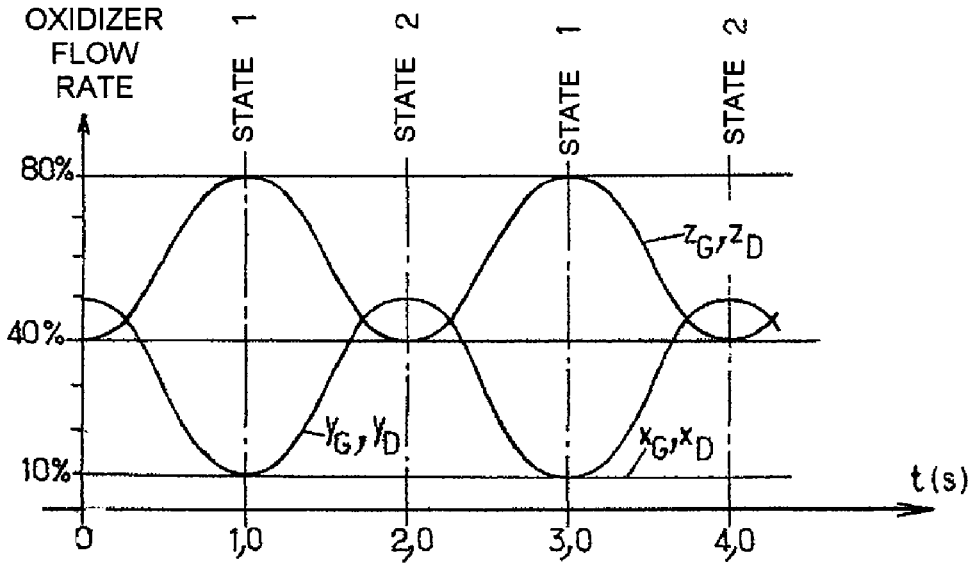
FIG.2a.
FIG.2b.
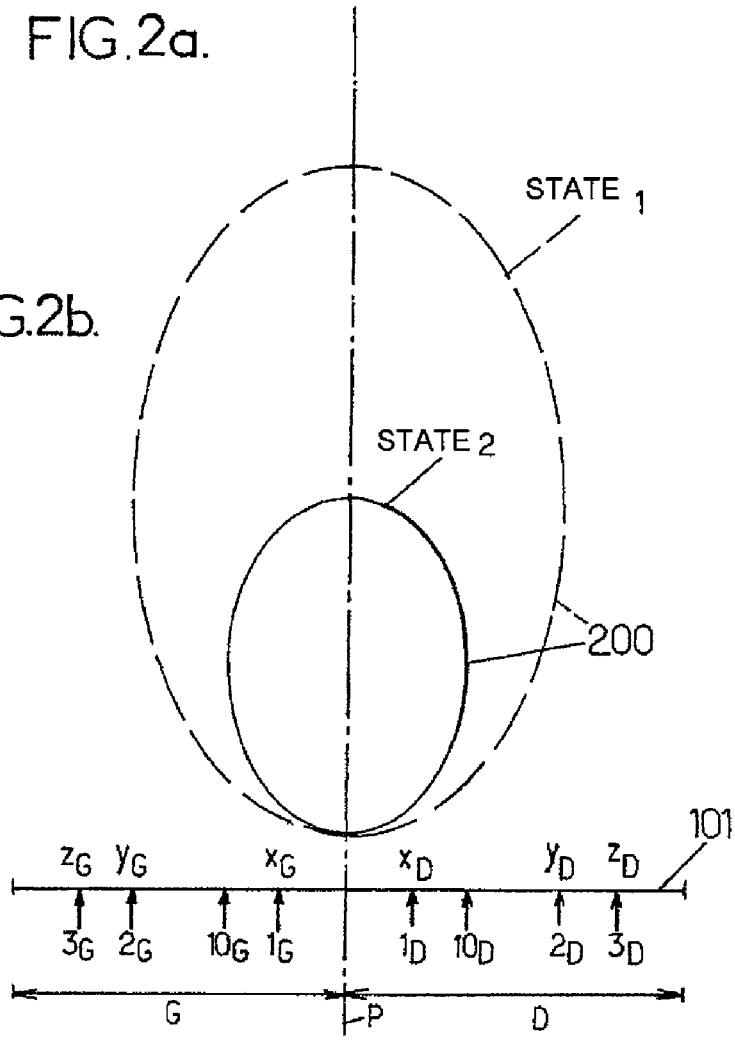

COMBUSTION METHOD WITH CYCLIC SUPPLY OF OXIDANT

This application is a 371 of International PCT Application PCT/FR2005/051033, filed Dec. 5, 2005.

BACKGROUND

The present invention relates to a combustion method for an industrial furnace. It also relates to a furnace suitable for implementing such a method.

The heating power distribution on a given furnace surface, the reduction of the quantity of nitrogen oxides produced, and the stability of the combustion flame(s) generated in the furnace, are among the main challenges in combustion furnace technology.

In fact, the energy efficiency and the profitability of an industrial combustion furnace are higher for large capacity furnaces. This is why the surface to be heated may be large. This is generally the upper surface of a charge of raw materials or melt contained in a chamber. It is accordingly difficult to distribute the heating power delivered by the combustion flame(s) substantially uniformly over the whole surface, to prevent the formation of colder zones that would be harmful to the melt or to the subsequent method for treatment thereof. For this purpose, a plurality of burners is known to be arranged in a furnace, at predefined locations above the chamber. In particular, two burners can be placed in parallel to one another, with respective horizontal flames directed in the same direction. Another alternative is to position the burners in opposing pairs, with the respective flames directed at one another within each pair.

Furthermore, the quantity of nitrogen oxides ($No_x$) produced in a combustion flame depends on the local oxygen and nitrogen concentrations, denoted $[O_2]$ and $[N_2]$. In particular, an evaluation of the quantity of thermally produced nitric oxide (denoted $[NO]_{th}$) is given by the following equation:

$$\frac{d[NO]_{th}}{dt} \approx \frac{k}{\exp\left(\frac{E_a}{RT}\right)} \cdot [O_2]^{1/2}[N_2] \quad (1)$$

where k is a numerical constant, exp denotes the exponential function, $E_a$ is a positive activation energy, R denotes the ideal gas constant and T is the local temperature.

In order to reduce the quantity of thermally produced nitric oxide, use of a substantially nitrogen-free oxidizer is known. Thus, an oxygen-enriched oxidizer is used instead of air. However, the reduction of the resulting nitrogen oxides is insufficient to meet the regulations in force.

To further reduce the quantity of nitrogen oxides produced, it is also known, particularly from U.S. Pat. No. 5,522,721 and EP 0 524 880, to cyclically vary the oxidizer flow rate and/or the fuel flow rate fed to the flame. The ratio between the local instantaneous concentrations of oxygen and fuel in the flame is accordingly different from the stoichiometry of the combustion reaction. The local temperature is consequently lower and, according to the equation (1), this causes a further reduction of the quantity of thermally produced nitric oxide. However, the flow rate variation parameters, such as the amplitude, the frequency and the phase of the variations of the flow rates, are difficult to adjust to obtain a satisfactory heating efficiency and a low release of carbon monoxide (CO). In fact, carbon monoxide is toxic and pollutant, and is generated by incomplete combustion when the local instantaneous oxygen concentration in the mixture is too low compared to the local instantaneous concentration of fuel.

Another way to obtain a further reduction of the quantity of nitrogen oxides produced consists in injecting a main part of the oxidizer and the fuel at two locations of the furnace separated from one another by a relatively long distance. A combustion carried out under these conditions is called "staged" (see for example EP 0 748 981). A small part of the oxidizer is also injected close to the fuel outlet to stabilize the combustion conditions. The main part of the oxidizer and the fuel are then mixed progressively in the spread volume where the jets overlap. In this way, a gap effect is also obtained, between the ratio of the local fuel and oxidizer concentrations on the one hand, and the stoichiometry of the combustion reaction on the other. Furthermore, this stoichiometric gap effect is superimposed on a dilution effect. The local temperature, and consequently the quantity of nitric oxide, are thereby also reduced. However, in this staged combustion configuration, the position of the flame in the vertical direction is particularly unstable. The efficiency of heating of the charged material is accordingly reduced and the roof refractories may be damaged.

It is therefore an object of the present invention to propose a combustion method which does not have the abovementioned drawbacks, or in which these drawbacks are reduced.

SUMMARY

Thus, the invention proposes a combustion method for an industrial furnace, in which two burner assemblies are placed substantially horizontally, parallel to one another and symmetrically about a median plane passing between the two assemblies. Each burner assembly comprises:

- a fuel injector;
- first, second and third oxidizer injectors placed respectively at increasing distances from the fuel injector.

An oxidizer feed system cyclically distributes a predefined flow rate of oxidizer among at least some of the second and third injectors of the two burner assemblies.

Since the burner assemblies are substantially horizontal, the flame produced in the furnace is itself contained in a horizontal plane. In this way, the heat produced by the flame is efficiently transferred to the furnace charge, without excessively heating the roof structure arranged above the furnace at a particular location thereof. Premature wear of the roof structure is thereby avoided.

The oxidizer is therefore introduced into the furnace at three points for each of the two burner assemblies. The first oxidizer introduction point is the first injector, which is the closest to the corresponding fuel injector. It serves to cause a first incomplete combustion of the fuel, which is then completed by the oxidizer introduced by the second and third injectors. The first injector also generally serves to stabilize the combustion conditions at its outlet. For each burner assembly, the third oxidizer introduction point is the farthest from the fuel injector, and the second oxidizer injector is located at an intermediate distance from the fuel injector between the distances from the first and third injectors.

The oxidizer preferably has an oxygen content above 30% by volume, and even above 70% by volume.

The total oxidizer flow rate introduced into the furnace is distributed among the first, second and third injectors of the two burner assemblies. A predefined part of this total flow rate is injected by the second and third oxidizer injectors, with a distribution among at least some of them which is cyclically variable. The predefined part of the total oxidizer flow rate injected by the two second and by the two third oxidizer injectors is substantially constant. It may optionally vary, but much more slowly than those of the individual flow rates of the second and/or third oxidizer injectors, which are variable. Thus, a predefined fraction of the oxidizer is injected into the furnace by some of the second and/or third injectors at a given time, and is then injected by the other second and/or third injectors at a later time. The oxidizer injection obtained by a device according to the invention is therefore alternated among some of said second and/or third injectors.

The cyclic distribution of the oxidizer flow rate among some of the second and third injectors of the two burner assemblies is preferably carried out at a frequency below 1 hertz. The flame oscillation period in the furnace is then longer than 1 second. The inventors have observed that such conditions procure particularly stable combustion.

In the staged combustion obtained, the fuel and oxidizer which are introduced into the furnace are diluted by the recirculation of the exhaust gases in the combustion zone. For this purpose, a main part of the oxidizer is introduced into the furnace at a long distance from the fuel introduction locations. By thereby delaying the mixing between the fuel and the oxidizer, the oxidizer is considerably diluted with the ambient gases present in the furnace before entering the main combustion zone. However, to stabilize the flame, it is also necessary to introduce oxidizer into the furnace close to each fuel introduction location. The part of oxidizer introduced close to the fuel is called primary flow, and that which is introduced at a distance from the fuel is called secondary flow.

Advantageously, the oxidizer feed system supplies the first injectors respectively of each burner assembly with respective primary oxidizer flow rates substantially equal at any time.

Each burner assembly generates a flame in the furnace, but when the two burner assemblies are not too distant from one another, their respective flames are combined and form a single combustion volume. Such a single flame is obtained, in particular, when the distance between the respective fuel injectors of the two burner assemblies is shorter than 30 times the diameter of each fuel injector. In the rest of this discussion, the term "flame" roughly designates the total volume in which combustion takes place, with the understanding that this volume may be divided into two parts for a large separating distance between the two burner assemblies.

The cyclic variations in the oxidizer flow rate distribution among at least some of the second and third injectors cause a horizontal shift of the flame in the furnace. Depending on the separating distance between the two burner assemblies and the shape of the curves of variations of the oxidizer flow rates of the second and third injectors, the shift in the flame consists of a fluctuation thereof between two positions or an oscillation of the flame between two configurations. In general, the cyclic variations in the gas distribution in the furnace improve the stability of the flame, particularly in the vertical direction, by shifting the flame alternately in a substantially horizontal direction.

Finally, the shift in the flame serves to further improve the heating power distribution throughout the volume of the furnace: a heat transfer to the furnace charge is obtained, which is more uniform thanks to the time averaging effect of the heat inputs taking place at each point of the furnace.

The invention also proposes a furnace suitable for implementing a method as described above.

BRIEF DESCRIPTION OF THE DRAWINGS

Other features and advantages of the present invention will appear from the description of two nonlimiting exemplary embodiments, with reference to the drawings appended hereto, in which:

FIG. 2*a* is a diagram of the variation in oxidizer flow rates of the first, second and third injectors of a furnace as in FIG. 1, according to a first embodiment of the invention;

FIG. 2*b* shows two configurations of the flame obtained at different times for the flow rate variations shown in FIG. 2*a;*

DETAILED DESCRIPTION

For the clarity of the figures, the dimensions of the devices shown are not in proportion to the actual dimensions. In particular, the dimensions measured in these figures which are associated with distinct actual dimensions are not transposed in the same scale ratio.

Figure 1:
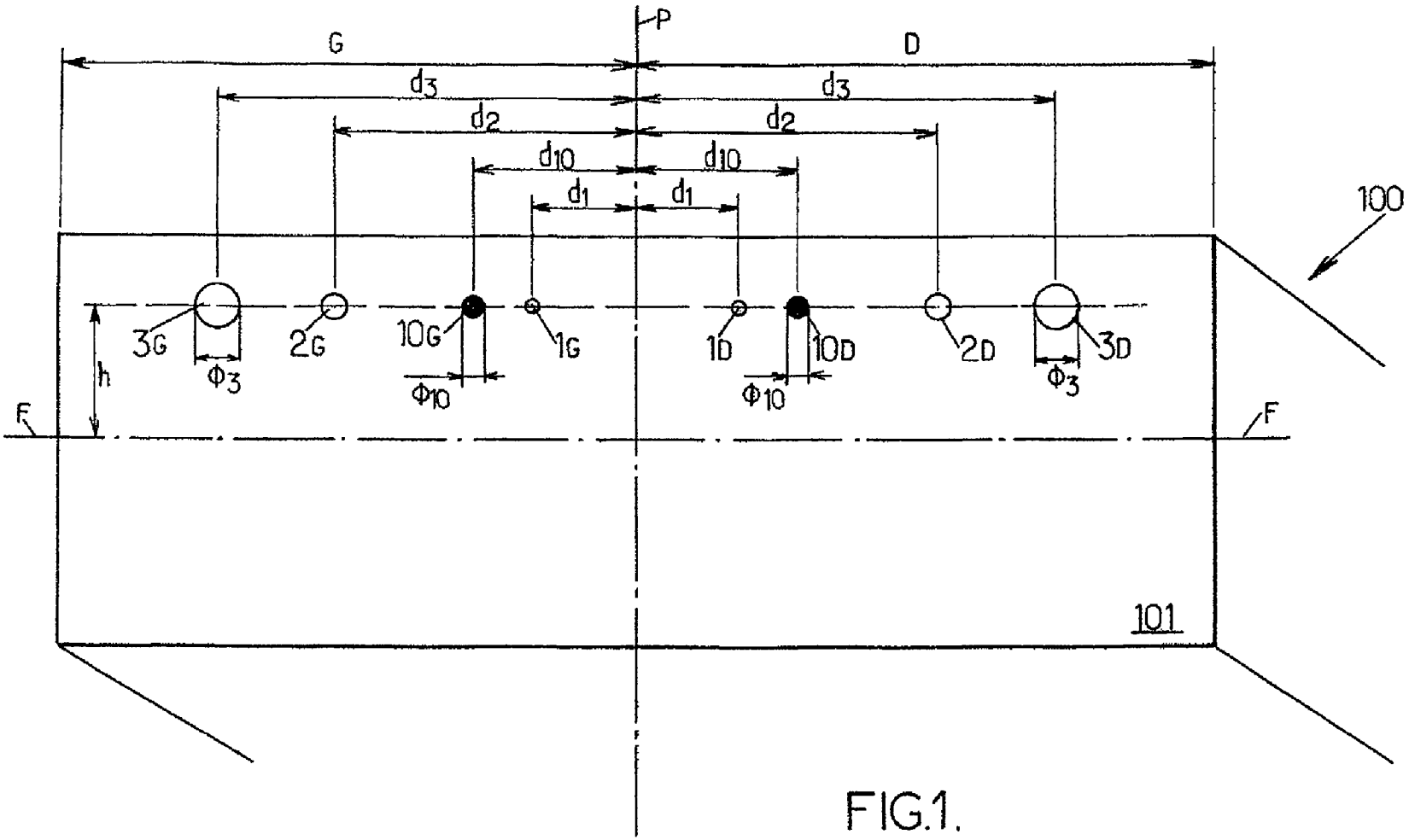
FIG. 1 shows the configuration of a furnace suitable for implementing the invention.

FIG. 1 shows a vertical wall 101 of a furnace 100, for example of a raw material melting furnace. The furnace 100 may have batch operation, with distinct charging, heating and furnace discharging steps, or continuous operation, with permanent flows of raw material charging and melt discharging. F denotes the free surface of material charged on the wall 101 of the furnace.

The fuel and oxidizer injectors are placed on the wall 101, with substantially horizontal respective fluid outlet directions. They are aligned with a horizontal line located at a height h above the line F. h is preferably between 250 mm (millimeters) and 550 mm.

The wall 101 is divided into two portions by a vertical median plane P, respectively left, denoted G, and right, denoted D. Injectors are located symmetrically on the two wall portions as follows:

- two fuel injectors, referenced $\mathbf{10}_G$ and $\mathbf{10}_D$, are placed respectively on the wall portions G and D at the same distance $d_{10}$ from the median plane P, measured horizontally;
- three oxidizer injectors, referenced $\mathbf{1}_G$, $\mathbf{2}_G$ and $\mathbf{3}_G$, are aligned in the wall portion G, respectively at distances $d_1$, $d_2$ and $d_3$ from the median plane P. The distances from the injectors of the wall portion G to the median plane P satisfy, for example, the following equation: $d_1<d_{10}<d_2<d_3$. The injectors $\mathbf{10}_G$, $\mathbf{1}_G$, $\mathbf{2}_G$ and $\mathbf{3}_G$ are generally located on the same horizontal line; and
- three oxidizer injectors $\mathbf{1}_D$, $\mathbf{2}_D$ and $\mathbf{3}_D$ respectively identical to the injectors $\mathbf{1}_G$, $\mathbf{2}_G$ and $\mathbf{3}_G$ and placed symmetrically thereto on the wall portion D.

The injectors $\mathbf{10}_G$, $\mathbf{1}_G$, $\mathbf{2}_G$ and $\mathbf{3}_G$ form a first burner assembly, associated with the left hand portion of the wall 101. For simplification, this burner assembly is denoted by G below. Similarly, the injectors $\mathbf{10}_D$, $\mathbf{1}_D$, $\mathbf{2}_D$ and $\mathbf{3}_D$ form a second burner assembly, denoted by D and associated with the right hand portion of the wall 101.

The fuel introduced into the furnace 100 by the injectors $\mathbf{10}_G$ and $\mathbf{10}_D$ may be gaseous or liquid. In the case of a liquid fuel, the injectors $\mathbf{10}_G$ and $\mathbf{10}_D$ each incorporate a spray nozzle in order to produce jets of fuel droplets.

Preferably, the distance $d_{10}$ between the fuel injector of each burner assembly, $\mathbf{10}_G$ or $\mathbf{10}_D$, and the median plane P is shorter than 15 times the diameter of each injector $\mathbf{10}_G$ or $\mathbf{10}_D$, denoted $\Phi_{10}$. Under these conditions, a single flame common to the two burner assemblies G and D is generated in the furnace 100.

The oxidizer introduced by the injector $\mathbf{1}_G$, $\mathbf{2}_G$, $\mathbf{3}_G$, $\mathbf{1}_D$, $\mathbf{2}_D$ and $\mathbf{3}_D$ is a gas normally having an oxygen content above 70% by volume.

Preferably, the third oxidizer injector of each burner assembly is located at a distance from the fuel injector of said assembly at least 10 times longer than the outlet diameter of the third injector. In other words: $d_3-d_{10}>10.\Phi_3$, where $\Phi_3$ denotes the outlet diameter of the injectors $\mathbf{3}_G$ and $\mathbf{3}_D$. Thus, the oxidizer jet of the injector $\mathbf{3}_G$, respectively $\mathbf{3}_D$, is sufficiently distant from the fuel jet of the injector $\mathbf{10}_G$, respectively $\mathbf{10}_D$, to obtain a staged combustion.

All the injectors of each burner assembly are directed substantially horizontally, so that the flame produced is parallel to the surface of the melt contained in the furnace 100.

Advantageously, the oxidizer feed system supplies each of the first injectors respectively of each burner assembly, that is, the injectors $\mathbf{1}_G$ and $\mathbf{1}_D$, with a constant respective primary oxidizer flow rate. The oxidizer feed system is then simplified, in terms of the supply of injectors $\mathbf{1}_G$ and $\mathbf{1}_D$. Preferably, the respective flow rates of the two injectors $\mathbf{1}_G$ and $\mathbf{1}_D$ are substantially equal: $x_G=x_D$, denoting by $x_G$ and $x_D$ the respective flow rates of the injectors $\mathbf{1}_G$ and $\mathbf{1}_D$. By way of example, $x_G$ and $x_D$ each correspond to 10% of the total oxidizing flow rate injected into each burner assembly.

According to a first embodiment of the invention, described with reference to FIGS. 2*a* and 2*b*, the oxidizer flow rates of two injectors placed symmetrically about the median plane P are equal at any time. By denoting by $y_G$, $y_D$, $z_G$ and $z_D$, the respective instantaneous flow rates of the injectors $\mathbf{2}_G$, $\mathbf{2}_D$, $\mathbf{3}_G$ and $\mathbf{3}_D$, the following equations are satisfied: $y_G=y_D$ and $z_G=z_D$. In other words, the oxidizer feed system supplies the second injectors respectively of each burner assembly with respective secondary oxidizer flow rates substantially equal at any time, and supplies the third injectors respectively of each burner assembly with respective tertiary oxidizer flow rates substantially equal at any time. For example, the supply system of the injectors $\mathbf{2}_G$, $\mathbf{2}_D$, $\mathbf{3}_G$ and $\mathbf{3}_D$ may comprise two identical distribution boxes assigned respectively to each burner assembly G and D. These distribution boxes are coupled with a common variable control member, and each box comprises a mobile wall for separating the oxidizer flows sent respectively to the second or third injector.

The flame obtained is accordingly centered on the median plane P and is symmetrical about it at any time.

FIG. 2*a* shows an example of the variation in flow rates $y_G$ and $y_D$ on the one hand, and the flow rates $z_G$ and $z_D$ on the other. The x-axis shows the time, indicated in seconds, and the y-axis shows the fraction of oxidizer flow rate of each burner assembly which is introduced by each injector thereof. It is assumed that the total oxidizer flow rate of each burner assembly G or D is constant, and that $x_G$ and $x_D$ are also constant and each equal to 10% of the flow rate of the corresponding burner assembly.

By way of example, $y_G$ and $y_D$ substantially vary sinusoidally between 10% and 50%, and $z_G$ and $z_D$ vary between 40% and 80%. The period of these variations is 2 seconds. The extreme configurations of the flame correspond to the following states:

state 1, in which $y_G=y_D=10\%$ and $z_G=z_D=80\%$ state 2, in which $y_G=y_D=50\%$ and $z_G=z_D=40\%$.

The volume of mixture is larger in state 1 than in state 2. According to FIG. 2*b* which shows the perimeter 200 of the flame in a horizontal plane passing through the injectors, state 1 corresponds to an extended flame, both in terms of width and length, and state 2 corresponds to a narrower and shorter flame. For the sake of clarity, the flow rate introduced into the furnace by each oxidizer injector is shown in FIG. 2*b*. In state 1, the fuel and oxidizer are more diluted in the flame. The temperature is then lower, but a better coverage of the entire surface of the charged material is obtained. The heat transfer from the flame to the furnace charge is then particularly uniform. Conversely, the flame is more concentrated and intense in state 2.

Figure 3A:
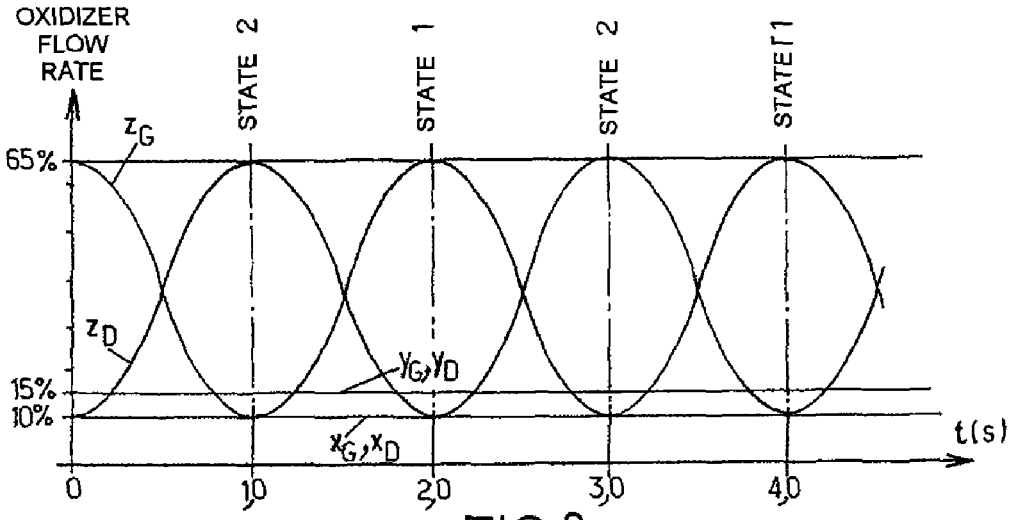
FIGS. 3*a* and 3*b* correspond respectively to FIGS. 2*a* and 2*b* for a second embodiment of the invention.
Figure 3B:
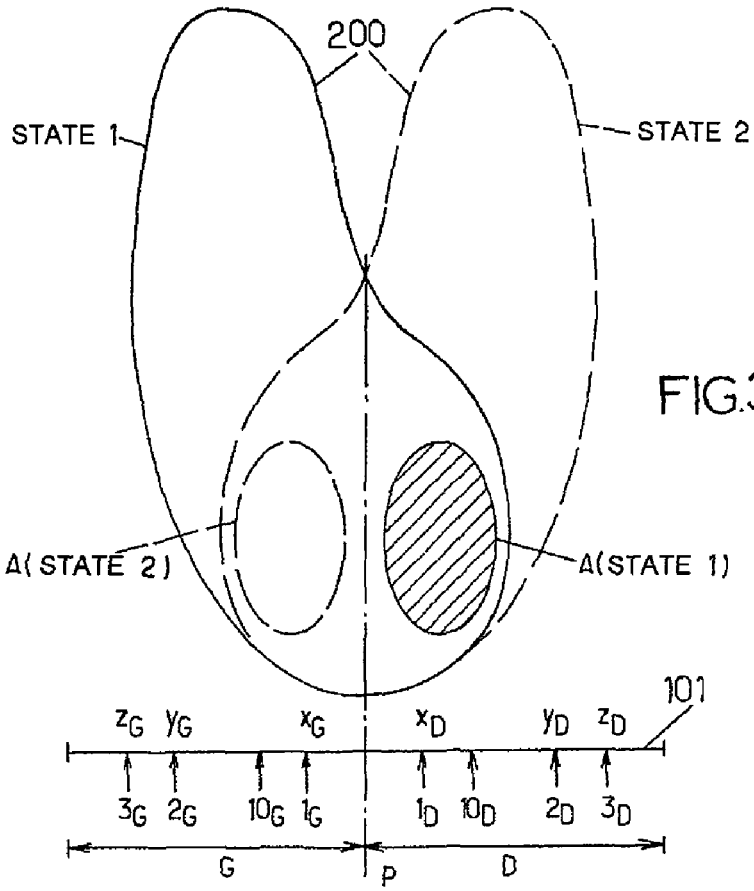

A second embodiment is now described in conjunction with FIGS. 3*a* and 3*b*. This second embodiment corresponds to an alternate oxidizer supply between the two burner assemblies. More particularly, the oxidizer feed system cyclically distributes a predefined total tertiary oxidizer flow rate said third injectors of the two burner assemblies.

The oxidizer feed system may further supply each of the second injectors respectively of each burner assembly with a constant respective secondary oxidizer flow rate. A particularly simple implementation of the alternate oxidizer feed is thereby obtained. Furthermore, the secondary oxidizer flow rates may be substantially equal.

The furnace and the burner assemblies used above from the first embodiment of the invention may be repeated without change for operation with alternate oxidizer feed. With the same notations and references, we now have: $x_G=x_D=x/2$ and $y_G=y_D=y/2$, where x denotes the total oxidizer flow rate introduced into the furnace 100 by the injectors $\mathbf{1}_G$ and $\mathbf{1}_D$, and y denotes the total oxidizer flow rate introduced by the injectors $\mathbf{2}_G$ and $\mathbf{2}_D$. x and y are respectively called the total primary and secondary oxidizer flow rates. Similarly, z denotes the total tertiary oxidizer flow rate, that is, the oxidizer flow rate introduced by the injectors $\mathbf{3}_G$ and $\mathbf{3}_D$. By way of example, x=10%, y=15% and z=75%, expressed as percentages of the total oxidizer flow rate introduced into the furnace. In general, x and y are substantially constant or vary much slower than the individual injector flow rates which vary cyclically.

The oxidizer feed system may be a distribution box connected to the injectors $\mathbf{3}_G$ and $\mathbf{3}_D$, which has a mobile separating wall placed between the oxidizer flows sent respectively to the injectors $\mathbf{3}_G$ and $\mathbf{3}_D$. FIG. 3*a* shows such an operation, whereby the equation $z_G+z_D=z$ is satisfied at any time. The y-axis in FIG. 3*b* shows the percentage of the total oxidizer flow rate introduced into the furnace, that is x+y+z. $z_G$ and $z_D$ each vary between 10% and 65%. The period of the flow rate variations is also 2 seconds.

The extreme flame configurations now correspond to the following states:

state 1, in which $z_G=65\%$ and $z_D=10\%$, state 2, in which $z_D=65\%$ and $z_G=10\%$.

The volume of mixture and the flame have symmetrical configurations between the preceding states 1 and 2 (FIG. 3*b*). In each of these states, the flame is shifted toward the side of the injector $\mathbf{3}_G$ or $\mathbf{3}_D$ having the higher oxidizer flow rate. Thus, the flame is shifted toward the left side in state 1, and toward the right side in state 2. This sideways fluctuation of the flame stabilizes the height thereof, so that the flame remains at a substantially constant difference from the free surface of the charged material on the one hand, and at a substantially constant distance from the furnace roof on the other. These two distances can then be well controlled, in order to obtain a uniform melting process and slow down the degradation of the roof refractories.

Furthermore, this sideways fluctuation of the flame procures a fairly uniform heat transfer between the flame and the furnace charge, in a horizontal direction parallel to the wall 101.

Due to the speed of the oxidizer at the outlet of the injectors $\mathbf{3}_G$ and $\mathbf{3}_D$, the flame is longer on the side of the injector $\mathbf{3}_G$ or $\mathbf{3}_D$ having the higher instantaneous oxidizer flow rate. This produces a good average coverage of the furnace surface by the flame. By way of example, the oxidizer is expelled by the injectors $\mathbf{3}_G$ and $\mathbf{3}_D$ at a speed of between 20 $m \cdot s^{-1}$ (meters per second) and 160 $m \cdot s^{-1}$, for example 90$m \cdot s^{-1}$. In general, the average distance of fuel and oxidizer, and the average distance at which combustion occurs, from the furnace wall 101, are commensurately longer as the speed of expulsion of the oxidizer by the injectors $\mathbf{3}_G$ and $\mathbf{3}_D$ is higher.

Furthermore, with each alternation, the high oxidizer flow rate introduced by one of the two injectors $\mathbf{3}_G$ and $\mathbf{3}_D$ causes a substantial dilution of the fuel on the side of the median plane P which corresponds to this injector. Conversely, the fuel is more concentrated in a zone of the flame offset to the median plane P on the side of the injector $\mathbf{3}_G$ or $\mathbf{3}_D$ which has the lower instantaneous oxidizer flow rate. This zone is denoted A in FIG. 3*b*, for flame perimeters 200 corresponding to each of the two states 1 and 2. The zone A hence shifts at each alternation between two symmetrical positions on either side of the median plane P.

Since the flame is richer in fuel in zone A, a larger quantity of soot is produced at this location. Simultaneously, zone A corresponds to the part of the flame that contributes most to the heat transfer to the charge at any time.

The existence of such a zone A inside the flame may be favorable or harmful to the material which is being melted, particularly depending on the chemical behavior of this material when the temperature is not uniform. According to an improvement to the second embodiment of the invention, the presence of such a zone A can be attenuated or exacerbated by varying the fuel flow rate of the injectors $\mathbf{10}_G$ and $\mathbf{10}_D$ at each alternation. For this purpose, a fuel feed system cyclically distributes a predefined total fuel flow rate among the fuel injectors of the two burner assemblies.

Advantageously, the fuel feed system is coupled with the oxidizer feed system so that the total fuel flow rate is cyclically distributed among the fuel injectors of the two burner assemblies in phase with or in phase opposition to the cyclic distribution of the total tertiary oxidizer flow rate among the third injectors of the two burner assemblies.

For example, another distribution box may be placed at the inlet of the injectors $\mathbf{10}_G$ and $\mathbf{10}_D$. This other distribution box has a mobile separating wall placed between the fuel flows sent respectively to the injectors $\mathbf{10}_G$ and $\mathbf{10}_D$.

The two distribution boxes, connected to the injectors $\mathbf{3}_G$ and $\mathbf{3}_D$ for the first, and to the injectors $\mathbf{10}_G$ and $\mathbf{10}_D$ for the second, can then be controlled synchronously in phase opposition: the fuel flow rate sent to one of the two injectors $\mathbf{10}_G$ or $\mathbf{10}_D$ is maximal or minimal at the same time that the oxidizer flow rate sent to the injector $\mathbf{3}_D$ or $\mathbf{3}_G$ on the opposite side is also maximal or minimal. A reinforcement of the zone A is thereby obtained, causing an increase in the luminosity of the flame close to the outlet of the fuel injector $\mathbf{10}_G$ or $\mathbf{10}_D$ when the fuel flow rate therein is a maximum. The fuel concentration is leaner on the side of the injector $\mathbf{3}_G$ or $\mathbf{3}_D$ for which the oxidizer flow rate is a maximum. This increased depletion causes a shortening of the flame at its furthest point from the injectors.

Conversely, the two distribution boxes can be controlled synchronously in phase. The fuel flow rate sent to one of the two injectors $\mathbf{3}_{10}$ or $\mathbf{3}_{10}$ is then maximal or minimal at the same time as the oxidizer flow rate sent to the injector $\mathbf{3}_G$ or $\mathbf{3}_D$ on the same side is also maximal or minimal. The zone A is then diminished and may merge with the overall extent of the flame. Said flame then oscillates between the two left and right hand sides with a higher transverse displacement amplitude. Simultaneously, the flame is elongated, so that the two effects are combined to obtain an optimal sweep of the entire furnace surface by the flame. This results in a particularly high average heat transfer surface to the charge.

Figure 4:
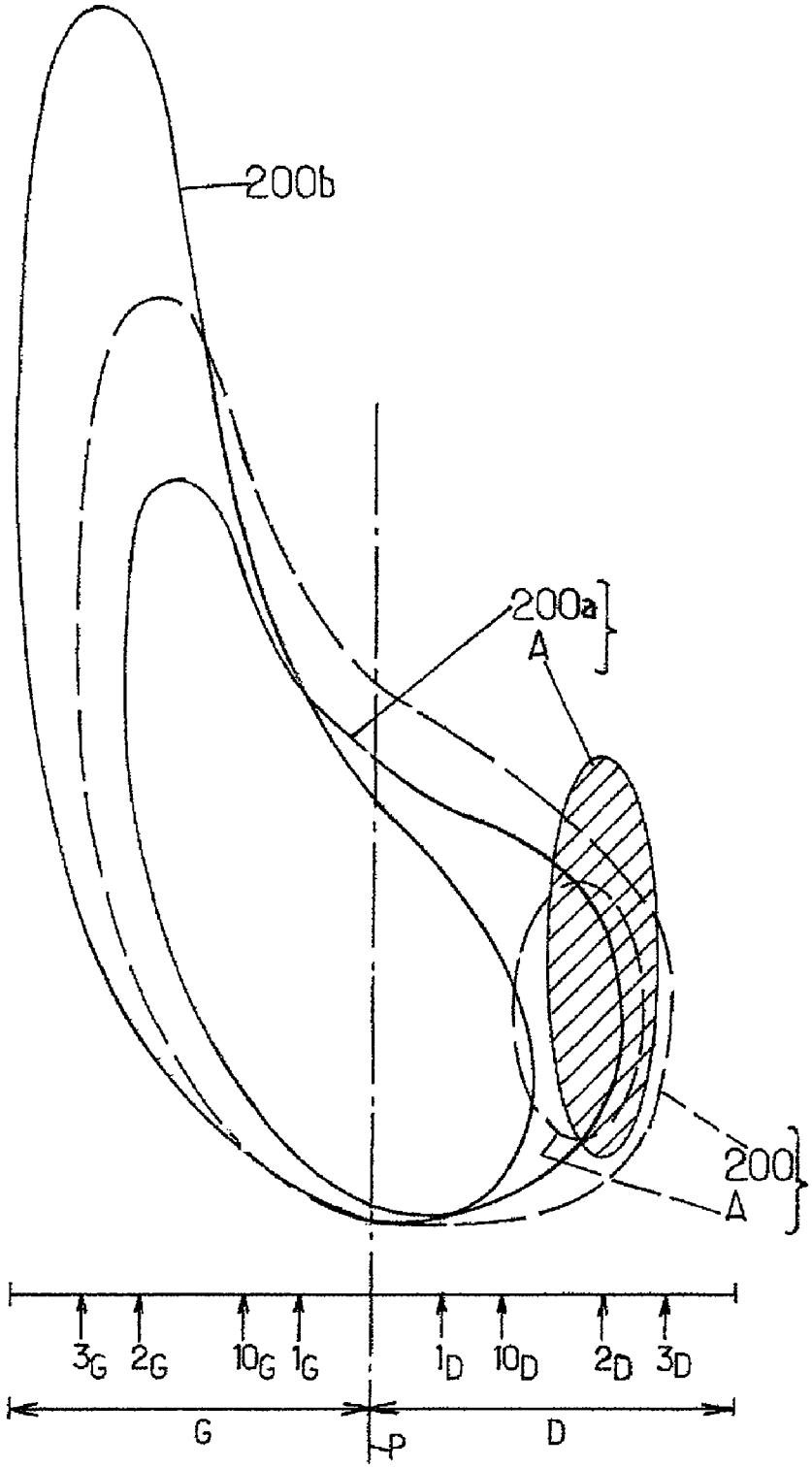
FIG. 4 shows various flame configurations corresponding to improvements of the second embodiment of the invention.

The flame perimeters obtained when the fuel flow rate distribution varies at the same time as the oxidizer flow rate distribution are shown in FIG. 4. The plots 200*a* and 200*b* correspond respectively to variations in phase opposition and in phase. The plot 200 corresponds to a constant fuel flow rate distribution, balanced between the two injectors $\mathbf{10}_G$ and $\mathbf{10}_D$. It is shown by a dotted line for comparison. The plots 200, 200*a* and 200*b* all correspond to identical total fuel and oxidizer flow rates. For the sake of clarity in FIG. 4, only the contour of the flame in state 1 defined above is shown for each case.

It is understood that numerous modifications and adjustments to the invention can be introduced with regard to the embodiments described in detail. Such modifications or adjustments may in particular take account of particular features, especially geometric, of the furnace in which the invention is implemented. Furthermore, the frequency of variation of the oxidizer flow rates can be adjusted in a manner known to a person skilled in the art, particularly to obtain a maximum combustion rate and to decrease the quantity of carbon monoxide produced.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A combustion method in which two burner assemblies are placed substantially horizontally, parallel to one another and symmetrically about a median plane passing between the two assemblies, each burner assembly comprising:

a) a fuel injector ($\mathbf{10}_G$, $\mathbf{10}_D$); and b) first ($\mathbf{1}_G$, $\mathbf{1}_D$), second ($\mathbf{2}_G$, $\mathbf{2}_D$) and third ($\mathbf{3}_G$, $\mathbf{3}_D$) oxidizer injectors placed respectively at increasing distances from the fuel injector ($\mathbf{10}_G$, $\mathbf{10}_D$), wherein:

a total oxidizer flow rate introduced into the furnace is distributed among the first, second and third injectors;

a predefined part of the total oxidizer flow rate is injected by the second and third oxidizer injectors ($\mathbf{2}_G$, $\mathbf{2}_D$, $\mathbf{3}_G$, $\mathbf{3}_D$);

an oxidizer feed system cyclically distributes the predefined part of the total oxidizer flow rate among at least some of the second and third injectors ($\mathbf{2}_G$, $\mathbf{2}_D$, $\mathbf{3}_G$, $\mathbf{3}_D$) of the two burner assemblies, the cyclical distribution being performed by:

distributing the predefined part between a portion I and a portion II, portion I being allotted to the second injectors ($\mathbf{2}_G$, $\mathbf{2}_D$) and portion II being allotted to the third injectors ($\mathbf{3}_G$, $\mathbf{3}_D$), wherein the relative distribution of the predefined part between portions I and II follows a cyclical pattern, the amount of portion I allotted to a first one ($\mathbf{2}_G$) of the second injectors ($\mathbf{2}_G$, $\mathbf{2}_D$) at any one moment is equal to the amount of portion I allotted to the other ($\mathbf{2}_D$) of the second injectors ($\mathbf{2}_G$, $\mathbf{2}_D$), and the amount of portion II allotted to a first one ($\mathbf{3}_G$) of third injectors ($\mathbf{3}_G$, $\mathbf{3}_D$) at any one moment is equal to the amount of portion II allotted to the other ($\mathbf{3}_D$) of the third injectors ($\mathbf{3}_G$, $\mathbf{3}_D$); OR the predefined part is divided into first and second portions, the first portion is allotted equally between a first one ($\mathbf{2}_G$) of the second injectors ($\mathbf{2}_G$, $\mathbf{2}_D$) and the other one ($2_D$) of the second injectors ($2_G$, $2_D$), the second portion is distributed between a first one ($3_G$) of the third injectors ($3_G$, $3_D$) and the other one ($3_D$) of the third injectors, wherein the relative distribution of the second portion between the first one ($3_G$) and the other one ($3_D$) of the third injectors ($3_G$, $3_D$) follows a cyclical pattern such that when a fraction of the second portion allotted to the first one ($3_G$) of the third injectors ($3_G$, $3_D$) goes up a fraction of the second portion allotted to the other one ($3_D$) of the third iniectors ($3_G$, $3_D$) goes down; and the flow rate of the predefined part is either constant or variable with the proviso that, if the flow rate of the predefined part is variable, the flow rate of the predefined part varies more slowly than the cyclical change in flow rates through the second ($2_G$, $2_D$) and third ($3_G$, $3_D$) injectors that is realized by the relative distribution of the predefined part between portions I and II and the flow rate of the predefined part varies more slowly than the cyclical change in flow rates through the first ($3_G$) and other one ($3_D$) of the third injectors that is realized by the relative distribution of the second portion therebetween.

2. The method of claim 1, in which the cyclic distribution of the oxidizer flow rate among some of the second and third injectors of the two burner assemblies ($2_G$, $2_D$, $3_G$, $3_D$) is carried out at a frequency below 1 hertz.

3. The method of claim 1, in which a distance between the respective fuel injectors ($10_G$, $10_D$) of the two burner assemblies is shorter than 30 times the diameter of each fuel injector ($\Phi_{10}$).

4. The method of claim 1, in which the oxidizer has an oxygen content above 30% by volume.

5. The method of claim 1, in which the third oxidizer injector ($3_G$, $3_D$) of each burner assembly is located at a distance from the fuel injector ($10_G$, $10_D$) of said burner assembly at least 10 times longer than the outlet diameter of said third injector ($\Phi_3$).

6. The method of claim 1, in which the oxidizer feed system supplies each of the first injectors ($1_G$, $1_D$) of each burner assembly with a constant respective primary oxidizer flow rate ($x_G$, $x_D$).

7. The method of claim 1, in which the oxidizer feed system cyclically distributes a predefined total tertiary oxidizer flow rate among the third injectors ($3_G$, $3_D$) of the two burner assemblies.

8. The method of claim 7, in which the oxidizer feed system supplies each of the second injectors ($2_G$, $2_D$) respectively of each burner assembly with a constant respective secondary oxidizer flow rate ($y_G$, $y_D$).

9. The method of claim 7, in which a fuel feed system cyclically distributes a predefined total fuel flow rate among the fuel injectors ($10_G$, $10_D$) of the two burner assemblies.

10. The method of claim 7, in which a flow rate of the combined oxidizer cyclically distributed among the third injectors is constant.

* * * * *